United States Patent [19]

Cramer

[11] 4,203,811

[45] May 20, 1980

[54] PROCESS FOR THE MANUFACTURE OF p-BENZOQUINONE-DIKETALS

[75] Inventor: Jürgen Cramer, Eppstein am Taunus, Fed. Rep. of Germany

[73] Assignee: Hoechst Aktiengesellschaft, Frankfurt am Main, Fed. Rep. of Germany

[21] Appl. No.: 938,043

[22] Filed: Aug. 30, 1978

[30] Foreign Application Priority Data

Sep. 1, 1977 [DE] Fed. Rep. of Germany ..... 2739316

[51] Int. Cl.[2] ..... C25B 3/02; C07C 41/00

[52] U.S. Cl. ..... 204/78; 204/59 R; 568/591

[58] Field of Search ..... 204/59 R, 78

[56] References Cited

U.S. PATENT DOCUMENTS 4,046,652 9/1977 Pistorius et al. ..... 204/78

FOREIGN PATENT DOCUMENTS 2460754 7/1976 Fed. Rep. of Germany ..... 204/59 R
2547383 4/1977 Fed. Rep. of Germany ..... 204/78
2547463 4/1977 Fed. Rep. of Germany ..... 204/78

*Primary Examiner*—F. C. Edmundson
*Attorney, Agent, or Firm*—Curtis, Morris & Safford

[57] ABSTRACT p-Benzoquinone-diketals of the formual I

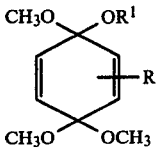

(I)

in which R is H, ($C_1$–$C_4$)-alkyl or halogen, and $R^1$ is ($C_1$–$C_4$)-alkyl, are prepared by anodic oxidation of benzene or an alkoxybenzene of the formulae

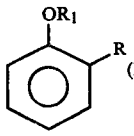

(II) or

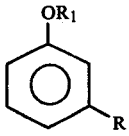

(III)

in which R and $R^1$ are as defined for formula I, in methanol containing less than about 5% by weight of water, in th presence of at least one alkali metal fluoride, ammonium fluoride and/or phosphonium fluoride as supporting electrolyte the pH being maintained below 7 by addition of HF.

It is especially advantageous to carry out the anodic oxidation in a continuous-flow cell with the use of bipolar electrodes of glass-like carbon wherein the cathode surface is coated with a material reducing the hydrogen overvoltage, preferably titanium carbide.

8 Claims, No Drawings

PROCESS FOR THE MANUFACTURE OF p-BENZOQUINONE-DIKETALS

It is known that p-benzoquinone-diketals of the formula I

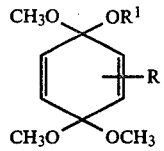

(I)

in which R is H, ($C_1$–$C_4$)-alkyl or halogen, and $R_1$ is ($C_1$–$C_4$)-alkyl, can be prepared by anodic oxidation of benzene or an alkoxybenzene of the formulae

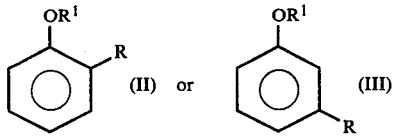

(II) or (III)

in which R and $R^1$ are as defined for formula I, in methanol containing less than about 5% by weight of water (Belgian Pat. No. 836,949). In this process, at least one ammonium or alkali metal fluoride, perchlorate, nitrate, tetrafluoroborate, hexafluorosilicate, hexafluorophosphate, benzene sulfonate, or p-toluene sulfonate and/or at least one quaternary ammonium and/or phosphonium salt is used as supporting electrolyte in an amount of from 0.2 to 15% by weight, relative to the electrolyte. The pH of the electrolyte has to be at least 7, that is, practically constantly alkaline, the alkaline medium being maintained, if necessary, by adding a slightly oxidizable base such as 2,6-lutidine. The oxidation temperature is from about −20° to +60° C., preferably from about 0° to 40° C.

The above Belgian Patent Specification stresses that the pH of the oxidation medium should not decrease into the acidic range (below 7), because otherwise the p-benzoquinone-diketals decompose very rapidly.

In further studies on the electrochemical reaction known from the cited Belgian Patent, it has now been found that this reaction, under special conditions, that is, choice of a determined supporting electrolyte and the presence of HF, also proceeds as intended in an acidic medium, and that the yields of p-benzoquinone-diketals in this case are even higher than those attained in an alkaline medium.

The subject of the present invention is therefore a process for the manufacture of p-benzoquinone-diketals of the formula I

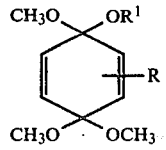

(I)

in which R is H, ($C_1$–$C_4$)-alkyl or halogen, and $R^1$ is ($C_1$–$C_4$)-alkyl, by anodic oxidation of benzene or an alkoxybenzene of the formulae

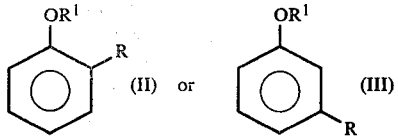

(II) or (III)

in which R and $R^1$ are as defined for formula I, in methanol containing less than about 5% by weight, preferably less than about 0.5% by weight of water, in the presence of at least one alkali metal fluoride, ammonium fluoride and/or phosphonium fluoride as supporting electrolyte; which comprises carrying out the anodic oxidation in a medium maintained at a pH below 7, preferably below 7 and down to about 3, especially about 5 to 6 by addition of hydrogen fluoride. The pH is measured by means of pH paper moistened with water or, preferably, by a glass electrode after having diluted the electrolyte with water in a (volume) ratio of 1:1. The cited pH values are obtained by adding from about 0.1 to 1 mol HF, preferably 0.3 to 0.8 mol HF, per mol of supporting electrolyte, advantageously in methanolic solution to the electrolyte. Larger amounts of HF, for example up to 3 mols HF/mol conducting salt, may in principle be employed; however, this does not bring about a technically interesting increase of yield.

Starting materials for the process of the invention are benzene or the alkoxybenzenes of the aforementioned formulae (II) and (III). Examples of such alkoxybenzenes are anisole, phenetole, n-butoxybenzene, o- and m-kresylmethyl ether, m-butylphenetole, o-chloroanisole, m-fluorophenetole, etc. Preferred are those alkoxybenzenes of the formula (II) and (III), where R is H, $CH_3$, Cl or F, possibly also Br, and $R^1$ is $CH_3$.

The use of benzene or anisole is especially recommended, and alternatively, of mixtures of these two substances, thus forming the unsubstituted p-benzoquinone-tetramethyl-diketal.

When starting from an alkoxybenzene of the formulae (II) or (III), where $R^1$ is an alkyl radical having from 2 to 4 carbon atoms, the corresponding p-benzoquinone-trimethylalkyl-diketal of formula (I) is formed in which one of the two ketal groupings contains therefore an alkoxy of from 2 to 4 carbon atoms in addition to the methoxy group. To a certain extent, however, reketalization occurs because of the methanol solvent being in exess, so that, even when starting from an alkoxybenzene (II) or (III) containing an alkoxy group of from 2 to 4 carbon atoms a certain amount of tetramethylketal is obtained.

Suitable supporting electrolytes for the process of the invention are alkali metal (Li, Na, K, Rb, Cs) fluorides, ammonium and/or phosphonium fluorides. In the latter fluorides, the ammonium and phosphonium groups may be present as unsubstituted $NH_4$ and $PH_4$ radicals as well as in a form 1 to 4 times substituted by alkyl of from 1 to 4 carbon atoms. Preferred are tetramethylammonium fluoride or tetramethylphosphonium fluoride, especially tetramethylammonium fluoride, besides cesium fluoride.

One single supporting electrolyte may be used as well as several of them simultaneously.

The concentration of the supporting electrolytes in the electrolyte depends on their solubility in the mixture of benzene or the corresponding alkoxybenzene (II) or (III) and methanol. However, it should not be too low, in order to keep the cell voltage as low as possible.

Generally, it is in the same range as that of the process of Belgian Pat. No. 836,949, that is, from about 0.2 to 15% by weight, relative to the total weight of the electrolyte; a concentration of from about 2 to 7% by weight being preferred. Hydrogen fluorides of the supporting electrolytes partially precipitating during the reaction are redissolved in the course of the electrolysis.

The concentration of benzene or the alkoxybenzene (II) or (III) in the electrolyte may vary within rather wide limits. Generally, amounts of from about 1 to 50 parts by weight, preferably 5 to 25 parts by weight of the starting substance are employed per 100 parts by weight of electrolyte.

The process of the invention may be carried out in partitioned or undivided cells. Suitable anode materials are above all metals of the platinum group (Ru, Rh, Pd, Os, Ir, Pt), glass-like carbon or graphite; as cathode materials, especially the metals of Groups I, IV, V and VIII of the Periodic System may be used, furthermore the carbides of such transition metals as Cu, Ag, Au, Ti, Fe, Ni, the metals of the platinum group, the carbides of Ti, Nb, Ta, Mo or W. These metals and carbides are also appropriate in the form of coatings on basis materials of different kind.

In a preferred embodiment of the invention, the anodic oxidation is carried out in an undivided cell (continuous-flow cell) with the use of bipolar electrodes of glass-like carbon the cathode surface of which is coated with one of the above metals or carbides, preferably titanium carbide.

The electrolysis can be carried out at a current density of up to about 400 milliamperes/cm$^2$, preferably of from about 50 to 250 milliamperes/cm$^2$.

The required voltage of the individual cell depends on the conductivity of the electrolyte, the current density and the distance between the electrodes, and is generally from about 4 to 25, preferably from about 5 to 10, volts.

The electrolysis is carried out at temperatures of from about 0° to 45° C., preferably about 25° to 35° C.

The electrolysis products obtained in the process of the invention can be easily worked up according to known methods by distillation or extraction without destroying the p-benzoquinone-diketal formed.

In contrast to Belgian Pat. No. 836,949, the process of the invention allows electrochemical preparation of p-benzoquinone-diketals in an acidic medium, thus obtaining higher, although not considerably higher, yields than according to the process of the cited Belgian Patent. A special advantage of the process of the invention resides in the fact that it gives constantly good yields when reusing the methanolic supporting electrolyte/HF residue for further batches contrary to the work-up residues of a batch electrolyzed in an alkaline medium without addition of HF. This means that the process of the invention is also very suitable for continuous operation.

The products of the process of the invention can be converted in known manner by hydrolysis to corresponding p-quinones. They are thus important intermediate products for the manufacture of p-quinones and their processing to corresponding hydroquinones which for their part are used in known manner in photography, as stabilizers for monomers, as starting materials for paint manufacture etc..

The following examples illustrate the invention. Example 1 demonstrates the current efficiency obtained by acidification of the electrolyte with hydrogen fluoride prior to the start of the operations. In Comparative Example I, the pH is maintained between 7.3 and 7.7 by continuous addition of 2-molar methanolic hydrofluoric acid. Comparative Example II indicates the current efficiency for a pH of 12 to 13. Example 2 demonstrates that there is no significant decrease of current efficiency when reusing the supporting electrolyte recovered according to the process of the invention, in contrast to Comparative Example III, where, on electrolysis in the alkaline range and with reuse of the supporting electrolyte recovered from Comparative Example II, the current efficiency decreases still further.

In Example 3, anisole is used as the starting material; in contrast the process in Comparative Example IV is carried out at a higher pH (7.3–7.7, that is, in a weakly alkaline range), which results in a decrease of the current efficiency of about 2%.

The other Examples demonstrate the function of the invention using different starting materials.

The current efficiency was determined in all cases by iodometric titration. For this purpose, about 2 cm$^3$ of the electrolytes obtained were weighed into about 15 cm$^3$ of 2N $H_2SO_4$. The quinone so formed by hydrolysis was reduced with potassium iodide and the iodine set free was titrated with sodium thiosulfate.

EXAMPLE 1

In a continuous-flow apparatus provided with pump, heat exchanger and degassing vessel, an undivided cell was inserted which contained an anode of glass-like carbon, a cathode of stainless steel and four bipolar electrodes of glass-like carbon. These four electrodes were coated with titanium carbide on their cathode surfaces and framed in polyethylene frames (see Application Ser. No. 938,049 (P 27 39 324) filed concurrently herewith) which frames had a width of 22 mm and a thickness of 2.5 mm vertically to the direction of electrolyte flow, and a width of 12 mm and a thickness of 3.5 mm parallelly to the direction of electrolyte flow, and which simultaneously acted as spacers. The active electrode area of each anode was 255 cm$^2$. In this cell, a mixture of 2070 g benzene, 420 g tetramethylammonium fluoride, 31.6 g hydrogen fluoride and 6630 g methanol (pH of the mixture 5.4, measured by means of a glass electrode after having diluted the electrolyte with water of a ratio of 1:1) was electrolyzed at 51 amperes and a cell voltage of 33.5 to 35.5 for 6 hours 38 minutes (corresponding to 1700 amperes/hour). Thereafter, the electrolyte (pH 5.6) contained 4.59 mols p-benzoquinonetetramethyl-diketal, corresponding to a current efficiency of 43.4% of the theory.

COMPARATIVE EXAMPLE I

In the test apparatus as described in Example 1, a mixture of 2070 g benzene, 420 g tetramethylammonium fluoride ride and 6630 g methanol (pH of the electrolyte 7.6) was electrolyzed at 51 amperes and a cell voltage of 33.5 to 36 volts for 6 hours 38 minutes (corresponding to 1700 amperes/hour). During this time, the pH was maintained constant at 7.3 to 7.7 by continuous addition of 404 g 2-molar methanolic hydrofluoric acid (that is, 2 mols HF/kg of mixture), corresponding to 16.2 g hydrogen fluoride. Thereafter, the electrolyte contained 4.38 mols p-benzoquinone-tetramethyl-diketal corresponding to a current efficiency of 41.5% of the theory.

COMPARATIVE EXAMPLE II

In the apparatus and cell as described in Example 1, a mixture of 2380 g benzene, 500 g tetramethylammonium fluoride and 6950 g methanol was electrolyzed at 51 amperes and 32 to 35 volts of cell voltage for 8 hours 38 minutes (corresponding to 2200 amperes/hour). The pH first rose rapidly from 7.6 to 12, and then slowly to 13.5. After termination of the electrolysis, the electrolyte contained 5.74 mols p-benzoquinone-tetramethyl-ketal corresponding to a current efficiency of 42.0% of the theory.

EXAMPLE 2

For reuse of the supporting electrolyte used in accordance with the invention, the electrolyte of Example 1 was worked up as follows: the benzene excess still present was subjected to an azeotropic distillation with methanol. From the remaining distillation residue, the p-benzoquinone-tetramethyl-ketal was extracted in counter-current flow with n-heptane, together with the by-products obtained. The remaining methanolic supporting electrolyte phase contained then 420 g tetramethylammonium fluoride, 18.0 g hydrogen fluoride and 902 g methanol, and a residual amount of about 2 g p-benzoquinone-tetramethyl-ketal.

This solution, mixed with 2070 g benzene, 5778 g methanol and 13.6 g hydrogen fluoride, was electrolyzed for 7 hours 2 minutes at 51 amperes and a cell voltage of 33 to 35 volts (corresponding to 1800 amperes/hr). The pH was from 5.4 to 5.7 during the operations. The electrolyte contained then 4.84 mols p-benzoquinone-tetramethyl-ketal corresponding to a current efficiency of 43.2% of the theory.

COMPARATIVE EXAMPLE III

In the apparatus and cell as described in Example 1, a mixture of 1300 g benzene, 310 g tetramethylammonium fluoride (recovered from the discharged electrolysis product of Comparative Example II in analogy to the method indicated in Example 2 and 3820 g methanol was electrolyzed for 6 hours 38 minutes at 51 amperes and a cell voltage of 27–31 volts (corresponding to 1700 amperes/hour). During the operations, the pH of the solution was maintained between 8 and 10.5 by continuous addition of 908 g 2-molar methanolic hydrofluoric acid (corresponding to 36.3 g hydrogen fluoride). Thereafter, the electrolyte contained 4.13 mols p-benzoquinone-tetramethyl-ketal corresponding to a current efficiency of 39.1% of the theory.

EXAMPLE 3

In the apparatus and cell as described in Example 1, a mixture of 1080 g anisole, 420 g tetramethylammonium fluoride, 31.6 g hydrogen fluoride and 6480 g methanol (pH of the solution 5.4) was electrolyzed at 51 amperes and a cell voltage of 33 to 33.5 volts for 4 hours 42 minutes (corresponding to 1200 amperes/hour). The pH was then 5.5 and the electrolyte contained 5.42 mols p-benzoquinone-tetramethyl-ketal corresponding to a current efficiency of 48.4% of the theory.

COMPARATIVE EXAMPLE IV

In the apparatus and cell as described in Example 1, a mixture of 1080 g anisole, 420 g tetramethylammonium fluoride and 6450 g methanol (pH of the solution 7.4) was electrolyzed for 4 hours 42 minutes at 51 amperes and a cell voltage of 33.5 to 34.5 (corresponding to 1200 amperes/hour). During this time, the pH was maintained at 7.3 to 7.7 by continuous addition of 208 g 2-molar methanolic hydrofluoric acid (corresponding to 8.32 g HF). Thereafter, the electrolyte contained 5.15 mols p-benzoquinone-tetramethyl-ketal corresponding to a current efficiency of 46.0% of the theory.

EXAMPLE 4

In a beaker-shaped glass cell provided with cooling jacket and magnetic agitator, a mixture of 28.4 g o-chloro-anisole, 7.44 g tetramethylammonium fluoride, 125 g methanol and 0.56 g hydrogen fluoride (pH of the solution 5.4) was electrolyzed for 5 hours at 3 amperes and a cell voltage of 8.2 to 9.5 volts (corresponding to 15 amperes/hour) at an anode plate of diabon (=graphite; 30 $cm^2$ of active electrode area) and a nickel cathode (30 $cm^2$ of active electrode area; 1 cm electrode distance). Thereafter, the solution (pH 5.7) contained 78.0 mmols of chlorobenzoquinone-tetramethyl-ketal corresponding to a current efficiency of 55.8% of the theory.

EXAMPLE 5

In the cell as described in Example 4, a mixture of 24.4 g phenetole, 7.44 g tetramethylammonium fluoride, 130 g methanol and 0.56 g hydrogen fluoride (pH of the solution 5.6) was electrolyzed for 5 hours at 3 amperes and a cell voltage of 10.9 to 12.7 volts (corresponding to 15 amperes/hour) at a diabon anode having 20 $cm^2$ of electrode area and a stainless steel cathode having 20 $cm^2$ of electrode area (electrode distance 1.1 cm). Thereafter, the electrolyte (pH 5.7) contained 73.2 mmols of the mixture of p-benzoquinone-tetramethyl-ketal and p-benzoquinone-trimethylethyl-ketal, corresponding to a current efficiency of 52.3% of the theory.

EXAMPLE 6

In the cell and electrode arrangement as described in Example 4 (however, the electrode distance was only 4 mm), a mixture of 24.4 g m-kresyl ether, 7.44 g tetramethylammonium methylate, 130 g methanol and 0.56 g hydrogen fluoride (pH of the solution 5.4) was electrolyzed for 5 hours at 3 amperes and a cell voltage of 5.9 to 6.2 (corresponding to 15 amperes/hour). Thereafter, the electrolyte (pH 5.7) contained 60.3 mmols of toluquinone-tetramethyl-ketal corresponding to a current efficiency of 43.1% of the theory.

What is claimed is:

1. In a process for the preparation of p-benzoquinone diketals of the formula

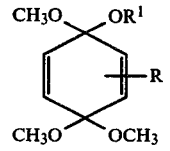

wherein R is hydrogen, an alkyl group having from 1 to 4 carbon atoms or halogen, and $R^1$ is an alkyl group having from 1 to 4 carbon atoms, by anodically oxidizing benzene or an alkoxybenzene of the formula

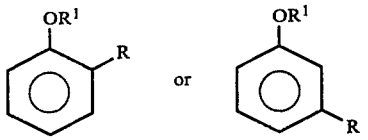

wherein R and $R^1$ are as defined above, in a methanolic solution containing less than about 5% by weight of water in the presence of at least one alkali metal fluoride, ammonium fluoride and/or phosphonium fluoride as a supporting electrolyte, the improvement which comprises the addition of hydrogen fluoride in an amount sufficient to conduct the anodic oxidation in a medium maintained at a pH below 7.

2. The process according to claim 1 wherein hydrogen fluoride is added in an amount of about 0.3 to 0.8 moles per mole of supporting electrolyte.

3. The process according to claim 1 wherein the starting materials for the anodic oxidation are benzene and/or anisole.

4. The process according to claim 1 wherein the supporting electrolyte is cesium fluoride and/or tetramethylammonium fluoride.

5. The process according to claim 1 wherein the anodic oxidation is conducted at a pH in the range of from about 3 to 7.

6. The process according to claim 1 wherein the anodic oxidation is conducted at a pH in the range of from about 5 to 6.

7. The process according to claim 1 wherein the anodic oxidation is conducted in a continuous-flow cell using bipolar electrodes of glass-like carbon in which the cathode surface is coated with a material which reduces hydrogen overvoltage.

8. The process according to claim 7 wherein the cathode surface is coated with titanium carbide.

* * * * *